US005378522A

United States Patent [19]

Lagomarsino

[11] Patent Number: 5,378,522

[45] Date of Patent: Jan. 3, 1995

[54] READY WRAP

[76] Inventor: Rich Lagomarsino, 5444 N. Del Mar, Fresno, Calif. 93704

[21] Appl. No.: 909,562

[22] Filed: Jul. 6, 1992

[51] Int. Cl.[6] ..... A44B 1/04; A44B 11/25; B32B 3/06; B32B 5/00

[52] U.S. Cl. ..... 428/100; 428/98; 428/99; 24/306; 24/442

[58] Field of Search ..... 428/98, 99, 100; 24/306, 442

[56] References Cited

U.S. PATENT DOCUMENTS

| | | | |
|---|---|---|---|
| 4,684,559 | 8/1987 | Wasko | 428/100 |
| 4,706,914 | 11/1987 | Ground | 428/100 |
| 4,722,477 | 2/1988 | Floyd | 428/100 |
| 4,759,963 | 7/1988 | Uso, Jr. et al. | 428/100 |
| 4,802,939 | 2/1989 | Billarant et al. | 428/100 |
| 4,933,224 | 6/1990 | Hatch | 428/100 |
| 5,004,144 | 4/1991 | Selga | 428/100 |
| 5,023,125 | 6/1991 | Gray | 428/100 |
| 5,084,321 | 1/1992 | Sui | 428/100 |
| 5,178,923 | 1/1993 | Andrieu et al. | 428/100 |

*Primary Examiner*—George F. Lesmes
*Assistant Examiner*—Kathryne E. Shelborne
*Attorney, Agent, or Firm*—Mark D. Miller

[57] ABSTRACT

Ready Wrap is a weatherproof, scratch resistant covering for hard to cover items. It is a material that can be bought in random lengths from a large roll and then hemmed with an ordinary cigarette lighter. Ready Wrap shall be available in a variety of widths in order to suit a variety of differing needs. Ready Wrap has Velcro attached along both edges (FIG. 1) so that it may be folded over bringing the Velcro hooks and loops in contact with each other forming a sealed envelope (FIGS. 3 & 6). Ready Wrap also may contain Velcro cross-striping (see FIG. 1, also FIGS. 2–7), this allows for sealed ends of this folded envelope to be achieved (FIGS. 3 & 6, also FIG. 4). Ready Wrap may also have a strip of Velcro running along the underside (FIG. 2) allowing for it to be rolled over on itself thereby creating a tubular form (FIG. 5). The ends of this tubular form may then be sealed by pressing the Velcro cross-striping together. Imagine FIG. 5 compressed along its horizontal axis. Ready Wrap, being made from Rip-Stop Polyethylene cloth, is quite strong and weather resistant and also hence the quality of being hemmed with the application of heat. Separate pieces of Ready Wrap may be joined together as illustrated in the drawings (FIGS. 4 and 7) or in a combination thereof.

As a possible ramification, Ready Wrap may also be manufactured in an endless variety of shapes and sizes to cover oddly shaped items such as a pistol, bottle, fishing reel, cross bow, etc. Holes or cut-outs may also be deployed in these variations.

10 Claims, 2 Drawing Sheets

READY WRAP

BACKGROUND OF INVENTION

This invention relates to a system of weatherproof protective material which is inexpensive, easy to use, and quite variable in its many applications. The Ready Wrap is able to be joined together so that pieces may be added onto each other making one larger piece of the same material. It is also capable of being folded, so that a sealed "envelope" or "tube" is achieved, and also able to be attached to the item being covered, such as a boat, recreational vehicle or other. This attachment is achieved with the simple application of Velcro strips to the item being covered.

BACKGROUND OF INVENTION, DISCUSSION OF PRIOR ART

The protective covers for the wooden handrails (and other wooden members) of a boat, usually a sailboat, must invariably be custom made due to the great variety of boats and the countless shapes and sizes of these handrails and other wooden members aboard the differing vessels. At present, canvas is used along with snaps which must be made by a professional marine canvas cover maker. The purpose of the Ready Wrap system is to allow the average boat owner to acquire brightwork (the exposed finished wood on a boat) protection cheaply and easily without the inconvenience and expense of having something custom made.

OBJECTS AND ADVANTAGES

The object of the Ready Wrap system is to provide an inexpensive and easy to use method of weatherproofing an item, such as the exposed wooden members, or brightwork found on a boat, usually a sailboat. Another advantage of this invention is the fact that closed "envelopes" or "tubes" may be achieved in a variety of sizes, allowing the user to make an endless array of bags, pouches or other such storage compartments or coverings in order to contain or cover and protect whatever object is desired. This is achieved by, the fact that individual pieces of Ready Wrap may be joined together, creating a multitude of shapes and sizes for the required purpose. The envelopes or tubes produced would be virtually dust and waterproof, allowing for weather protected storage or transportation of the items therein. The utilization of the Ready Wrap system is limited only by the imagination of the user.

DESCRIPTION OF DRAWINGS

Note: No dimensions are given since Ready Wrap should come in a variety of widths ranging from about six inches to four feet with the "cross-striping" (the Velcro strips which run perpendicular to the outside edge and almost to the middle) Velcro arranged proportionally.

FIG. 3: Shows a folded end-view. The reader is asked to imagine a length of Ready Wrap being cut from the bulk roll (FIG. 1) and simply folded over connecting the opposing Velcro hooks and loops as viewed end-on.

DETAILED DESCRIPTION OF DRAWINGS

PREFERRED EMBODIMENTS

Ready Wrap consists of a width of material with Velcro attached along each edge along the top. This allows the material to be folded bringing the Velcro together and forming a sealed compartment. The most desirable material for this purpose would possibly be Rip-Stop Polyethylene cloth.

Figure 1:
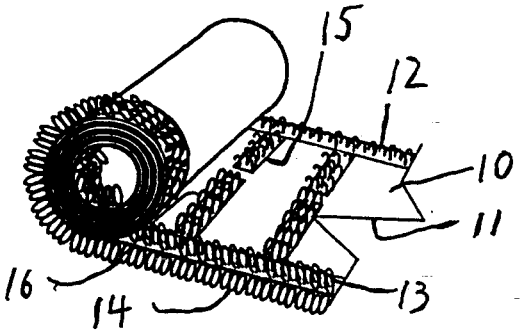
FIG. 1: Shows a perspective end-view of Ready Wrap as it would appear being unrolled from a bulk roll.

FIG. 1 shows a perspective view of a bulk roll of a piece of releasable attachable protective covering material (henceforth termed "Ready Wrap"). This drawing is not drawn to scale. All seven figures are drawn out of proportion, in that they depict the releasable attachable co-operating hooks and loops (henceforth termed Velcro hooks and loops), being much bigger than they really are with respect to the width of the covering material itself. The width of the protective covering material itself shall vary. Bulk rolls shall exist in a variety of widths from 6, 8, 12 and 18 inches and 2, 3 and 4 feet.

Again, referring to FIG. 1, said protective covering material having on the uppermost surface 10 Velcro hooks 12 and 15 along one side of a centerline drawn along the length of surface 10, and Velcro loops 13 and 16 diametrically opposed and bonded to the opposite side of said imaginary lengthwise centerline. Also, the underside surface 11 shows Velcro loops 14 bonded along this lengthwise edge.

Figure 2:
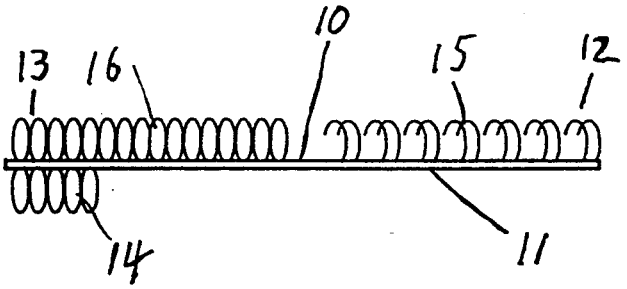
FIG. 2: Shows an end-view of Ready Wrap. Note that the Velcro hooks and loops continue from the outside edge almost to the middle of the material. Also note that the underside of the material contains the Velcro loops.
Figure 6:
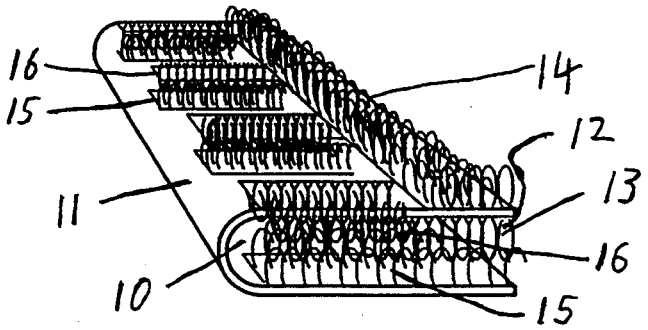
FIG. 6: Shows a perspective view of a folded (FIG. 3) length of Ready Wrap in a phantom illustration. The unseen "cross-striping" as shown in FIG. 1 are indicated with broken lines.

FIG. 2 shows an end view of Ready Wrap material. Here, the Velcro cross-striping 15 and 16 which can be seen placed at regularly spaced intervals along surface 10, in FIGS. 1 and 6, is shown to continue to almost to the center from an outside edge at 90 degrees to the outside edges 12 and 13.

Figure 3:
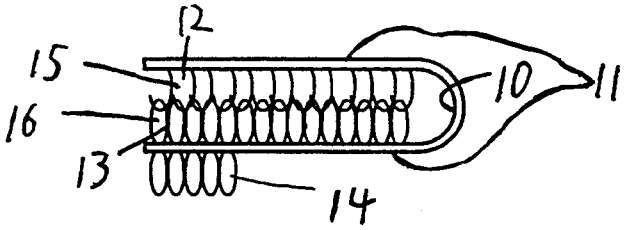

FIG. 3 shows what would happen if we were to fold FIG. 2 bringing into contact co-operating Velcro hooks 12 and loops 13. Also shown engaged in releasable attachment are Velcro hooks 15 and loops 16. Surface 10 hereby becomes the inside of this folded embodiment, while surface 11 becomes the outside (refer to FIG. 6). Velcro loops 14 remain on the outside (surface 11) and are thus unengaged in this depiction.

Figure 4:
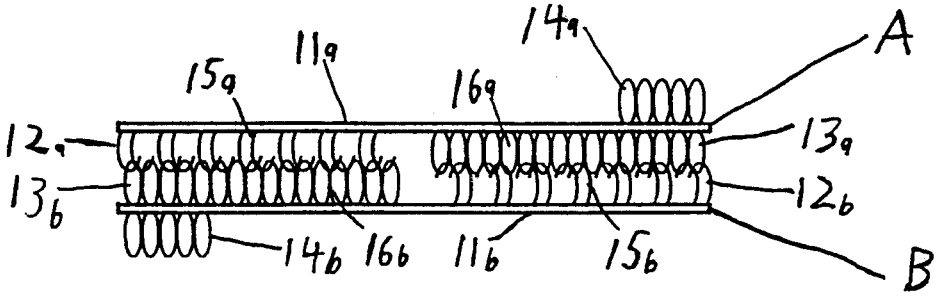
FIG. 4: Shows an end view of two pieces of Ready Wrap joined face to face. Here, the hooks of one piece connect with the loops of another piece forming a continuous series of individual pockets. The reader is asked to imagine a length of Ready Wrap being covered with another piece that has been turned end for end. In other words, the hooks and loops of one piece run opposite of the other piece .allowing the two pieces to be joined face to face.

FIG. 4 shows an end view of two (2) pieces of Ready Wrap co-joined. Here the Velcro hooks 12*a* of the first, or uppermost piece "A" are engaged with the Velcro loops 13*b* of piece "B." Conversely, the Velcro hooks 12*b* of piece "B" are engaged with the Velcro loops 13*a* of piece "A." Also, the cross-striping 15*a* and 16*a* of piece "A" is engaged with the cross-striping 16*b* and 15*b* of piece "B." This embodiment results in a series of sealed compartments for storage or transportation of dust and/or weather protected items.

Figure 5:
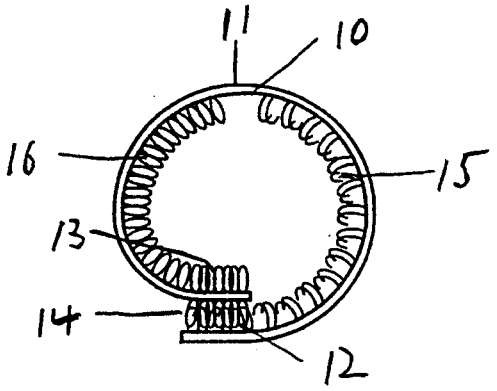
FIG. 5.: Shows an end view of a piece of Ready Wrap that has been wrapped upon itself forming a tube shape. This happens when the side with the hooks is wrapped around and over the other side connecting with the loops running along the underside of the opposite edge (refer to FIG. 2).

FIG. 5 shows the Ready Wrap releasable attachable protective covering material rolled as a tube shape. Such would be the possible application should a person wish to cover and thereby protect from the elements the wooden mast or boom of a ship. Here, the Velcro hooks 12 on surface 10 engage with the Velcro loops 14 on surface 11. In this embodiment the Velcro hooks 15 do not engage with the Velcro loops 16 as they are being physically held apart by the object being covered.

FIG. 6 is a perspective phantom illustration. Ready Wrap is shown folded in what would be a typical and primary example of its intended use. This is what FIG. 3 would look like inverted and viewed in a cutaway perspective. Here, we can see the hooks 12 on surface 10 engaging the loops 13 also on surface 10 (refer to FIG. 1). Also, the cross-striping hooks 15 are shown engaging their co-operating counterparts the loops 16, both of which are on surface 10. Surface 10, in this example, becomes the inside of a series of sealed compartments. Surface 11, in this example, becomes the outside of a series of sealed compartments. The Velcro loops 14 that are bonded along the external edge of surface 11 (refer to FIGS. 1 & 3) remain unengaged in this example.

Figure 7:
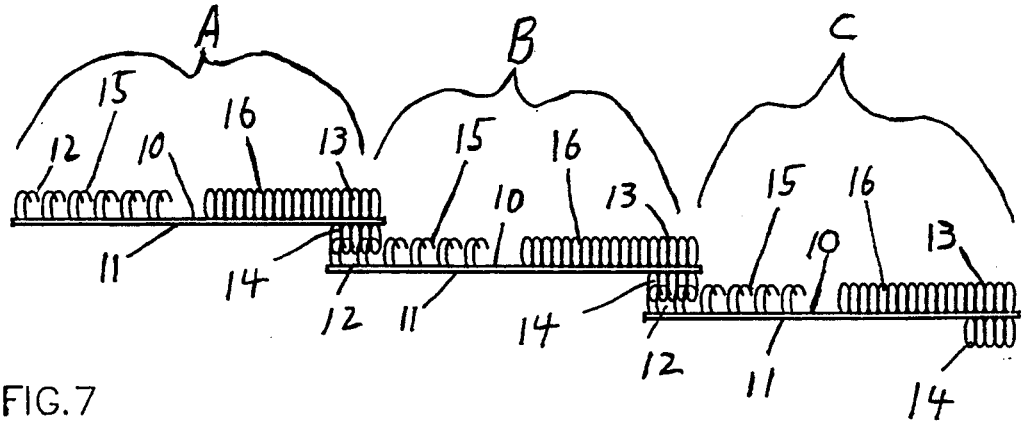
FIG. 7: Shows three separate pieces of Ready Wrap that have been connected together. The illustration is inverted so as to comply with FIGS. 1 and 2.

FIG. 7 shows three (3) pieces of Ready Wrap releasable attachable protective covering material joined edge-to-edge or side-by-side. Here, the Velcro loops 14 on surface 11 of piece "A" are engaging the Velcro hooks 12 on surface 10 of piece "B." At the same time the Velcro loops 14 on surface 11 of piece "B" are engaging the Velcro hooks 12 on surface 10 of piece "C." In this manner, pieces of Ready Wrap may be joined together in order to form a larger piece of the same material. This larger formation having the same properties as a single piece in that it may be folded or rolled upon itself bringing into contact the externally exposed hooks 12 of piece "A" with the loops 13 or 14 of piece "C."

While the above description contains many specificities, the reader should not construe these as limitations on the scope of the invention, but merely as exemplifications of preferred embodiments thereof.

Operation of Invention

The operation of the Ready Wrap covering or weatherproofing system is as follows. The consumer purchases a predetermined length which is cut from a bulk roll in, most likely, a marine supply or home improvement store (see FIG. 1). As is specified above, the most desirable material to utilize in the manufacturing of Ready Wrap to date could conceivably be Rip-Stop Polyethylene cloth. The advantages of this material are multi-dimensional.

First is the inherent quality of this material's durability. It will not rot, it is very strong, it is extremely difficult to tear or stretch and it is inexpensive. Although it is somewhat affected by ultra-violet light (it fades), it is impervious to the harmful effects of water.

Another advantage of using the Rip-Stop Polyethylene cloth in the manufacturing of Ready Wrap is that it can be "hemmed" by simply melting the edge with a common cigarette lighter. A heat-knife will also cut and hem in one severing and searing motion. Therefore, the first operation the buyer would perform after purchasing a desired amount of the revolutionary Ready Wrap would be to cut the material to the necessary lengths required to cover what he or she has in mind. Then, to hem the frayed edges along the cut line with a cigarette lighter, or some other source of flame or applied heat. Now Ready Wrap is ready to be used.

The next few paragraphs refer to the use of Ready Wrap as a means to cover certain exposed members of a sailboat. A working knowledge of sailing terms is required. This is the primary intended purpose of this invention. It is also the circumstance of conception, in that Ready Wrap came to mind as a result of attempting to find a method of protecting our own sailboat from the harmful effects of being constantly exposed to the weather. Anyone who is familiar with refinishing the "brightwork" (the finely sanded and varnished exposed and finished wood on a boat) will immediately appreciate the obvious value of Ready Wrap. However, the reader is asked to keep in mind that Ready Wrap is applicable to a countless number of uses other than the few stated herein.

Having hemmed the edge of a piece of Ready Wrap, the user could quite simply roll this around the wooden tiller (see FIG. 5). Since there is Velcro running 90 degrees to the edge and almost to the middle of the Ready Wrap (see FIG. 1), this end may be pressed closed at the end of the tiller handle thereby sealing that end. With the addition of a grommet or ringlet, or even a simple hole, a length of Ready Wrap might be drawn up a wooden mast with the main halyard while either wrapping it together as shown in FIG. 5, or folding it as shown in FIG. 3. In the latter example, the 90 degree cross-striping would be held apart by the mast itself and would not interfere with the aforementioned operation. In the case of a detachable mast or other such spar, a long pouch may be achieved which is sealable at both ends. As in the case of the mast, the boom may be similarly covered as well, using either the wrapping or folding method, with the sail either on or off.

On most longer sailboats there is a handrail that runs along the top of the cabin, these handrails can also be found at other locations on the boat, such as the forward deck. These handrails are usually about three inches high and would be covered by using a piece of Ready Wrap that comes in the six inch width. This is accomplished by using the folding method of securing Ready Wrap and pressing the two edges together through the cut out holes in the rail. The cross-striping would not come into play except to seal the ends.

On some boats there are splash guards that are mounted along the top of the cockpit. These are anywhere from four to six inches high. By permanently mounting strips of Velcro to the vessel these may be covered using Ready Wrap as well. The Velcro loops and hooks (purchased separately, yet should be sold alongside Ready Wrap as an obvious appurtenance thereto) should be mounted as follows: Affix the Velcro loops to the inside of the cockpit. This is because of the Velcro hooks were to be mounted here they would stick to someone wearing a sweater. Attach the Velcro hooks to the outside of the splash guard just above the deck or to the deck itself. Velcro strips, which are bought separately, may be attached along the decks, on either side of the hatch cover or anyplace else in order to implement the use of Ready Wrap.

Pieces of Ready Wrap may be joined together so as to make a larger piece of the same material, see FIG. 7. In this manner, irregular shapes and a variety of different sizes can be created.

Two pieces of Ready Wrap may be joined together face to face as shown in FIG. 4. Here, the result would be a series of compartments that open along either side or from either end. This might be used by someone wishing to store or transport a number of items while keeping them dust, weather, insect or scratch proof.

Conclusion and Ramifications, Scope of Invention

The foregoing pages have dealt with Ready Wrap as a system allowing the average boat owner to safeguard his vessel from the damaging effects of the weather, primarily the sun, on his beautiful "Other Lady," his boat. While the above description contains many specificities, these should not be construed as limitations on the scope of the invention, but rather as an exemplification of one preferred embodiment thereof. Many other variations are possible.

One may be that Ready Wrap may only have the Velcro running the two edges with no cross-stripping and no Velcro loops along the underside. (The Velcro loops are used on what might be an exposed edge, as in FIG. 3, so as to not "hook" on other material, i.e., wool, clothing, burrs, threads, etc.) However, the inclusion of Velcro hooks along the underside is not unforseen and should be included in the scope of the conceptualization of this invention.

The widths, as would seem most probable, would be 6, 8, 12, 18, 24, maybe 36, and lastly, 48 inches. The 6, 8, and 12, inch widths should have the Velcro cross-striping at 6 inch centers. The 18 and 24 inch widths should have the Velcro cross-striping at 12 inch centers. Lastly, the 3 and 4 foot widths should have cross-striping at 2 foot centers. These dimensions are approximations, they are subject to a degree of flexibility according to the manufacturer's discretion.

Possible novel features may include ringlets, holes or cut-outs in the fabric or, as previously mentioned, the implementation of utilizing the Velcro in other positions than specified above. This includes either the addition of more, or differently placed Velcro, or the subtraction and/or reorganization of the Velcro as has been stated heretofore.

Another ramification of the original conception would be the manufacture of the Ready Wrap in precut lengths, shapes, or sizes. In other words, predetermined units that may be used for specific purposes.

The use of Ready Wrap as a scratch-cover type of transport medium is environmentally correct in that Ready Wrap may be reused as is, cut and made smaller, or pieced together to form larger pieces.

Ready Wrap may someday serve as a replacement for some of the styrenes and foam fillers used in current shipping, or in situations where items are stored or shipped in plastic bags or pouches. The consumer may also create his own pistol pouches, scratch-covers for lanterns, odd-shaped pouches for fishing reels, tools, etc., or any number of other items which need to be covered or protected from the elements and/or damage from scratching abrasion and so forth. In addition, a chain of pockets that may contain items such as ceramic figurines, delicate instruments or perhaps Christmas tree ornaments may also be created.

The scope and implementation of Ready Wrap is limited only by the imagination of the user.

What is claimed is:

1. A protective covering for an item comprising a plurality of fabric pieces, each such piece further comprising a cross-section of material having an upper and lower surface a firsthook and loop attachment means provided in parallel along two opposite edges of the upper surface of each such piece, and a second hook and loop attachment means along one edge of said lower surface, said attachment means allowing for the releasable attachment of each such piece to another such piece in order to surround the item being covered by the engagement of cooperating hooks an loops, wherein such pieces may be attached to one another.

2. A protective covering according to claim 1 wherein said cooperating hooks and loops comprise a plurality of stems projecting at generally a right angle from said material and having enlarged generally semi-spherical heads on their distal ends, hereinafter termed as loops.

3. A protective covering according to claim I wherein said cooperating hooks and loops comprise a plurality of stems projecting at generally a right angle from said material and having heads on their distal portions, said heads including hook-like projections projecting along said stems toward said material, hereinafter termed as hooks.

4. A releasable attachable covering material according to claim 1 wherein a series of hooks is bonded to an edge of said covering material and continues along the aforementioned edge uninterrupted or in a series of regularly spaced intervals and wherein a series of loops is bonded to the opposite edge of said covering material and continues along this opposing edge uninterrupted or in a series of regularly spaced intervals so that said covering material may be folded once upon itself thereby bringing the two opposing edges in contact with each other, thus engaging the co-operating releasable attachable hook and loop mechanism.

5. The protective covering material according to claim 1 wherein said attachment means is comprised of loops and hooks that are bonded to said material at regularly spaced intervals at 90 degrees to the length of said material.

6. A releasable attachable protective covering material according to claim 5 wherein said co-operating loops and hooks continue from the outermost edge at 90 degrees to that edge to approximately the center of said length of material.

7. A releasable attachable protective covering material according to claim 5 wherein the hooks are placed at regularly spaced intervals on one side of and at 90 degrees to a lengthwise drawn centerline and the cooperating loops are diametrically opposed on the opposite side of said lengthwise drawn centerline allowing for releasable attachment of said cooperating hooks and loops.

8. The protective covering material described in claim 4 wherein the co-operating hook and loop mechanisms are bonded to the uppermost and also to the lower side of each edge of said material said edges being outermost to a centerline drawn lengthwise upon said material.

9. A protective covering device comprising a fabric sheet having an upper surface, a lower surface, and at least two opposite edges, a first interengaging means of loops mounted along one entire edge of each such sheet on both the upper and lower surface thereof, a second interengaging means of hooks mounted along the entire opposite edge of each such sheet on the upper surface thereof, and a plurality of interengaging hooks and loops disposed at periodic intervals across the upper folded in half against itself engaging the first and second interengaging means forming a protective pouch.

10. The device described in claim 9 above wherein a plurality of such fabric sheets are provided, each such sheet having identical interengaging means mounted thereon whereby the interengaging means on a given sheet may be engaged with the corresponding interengaging means on a different sheet to form a larger combined protective covering.

* * * * *

UNITED STATES PATENT AND TRADEMARK OFFICE

CERTIFICATE OF CORRECTION

PATENT NO. : 5,378,522

DATED : January 3, 1995

INVENTOR(S) : Rich Lagomarsino

It is certified that error appears in the above-indentified patent and that said Letters Patent is hereby corrected as shown below:

The following should be included as part of Claim 9 beginning on column 7, line 10 following the word "upper"

--surface of said sheet between said first and second interengaging means whereby the upper surface of each such fabric sheet may be--

Signed and Sealed this

Twenty-fifth Day of July, 1995

*Attest:*

Bruce Lehman

BRUCE LEHMAN

*Attesting Officer*

*Commissioner of Patents and Trademarks*